US009556607B2

(12) United States Patent
Yamada et al.

(10) Patent No.: US 9,556,607 B2
(45) Date of Patent: Jan. 31, 2017

(54) METHOD FOR CONSTRUCTING CYLINDRICAL TANK

(71) Applicant: IHI Corporation, Tokyo (JP)

(72) Inventors: Juichiro Yamada, Tokyo (JP); Shigeki Kato, Tokyo (JP)

(73) Assignee: IHI CORPORATION, Tokyo (JP)

( * ) Notice: Subject to any disclaimer, the term of this patent is extended or adjusted under 35 U.S.C. 154(b) by 0 days.

(21) Appl. No.: 14/959,154

(22) Filed: Dec. 4, 2015

(65) Prior Publication Data

US 2016/0083957 A1 Mar. 24, 2016

Related U.S. Application Data

(63) Continuation of application No. PCT/JP2014/066998, filed on Jun. 26, 2014.

(30) Foreign Application Priority Data

Jun. 27, 2013 (JP) ..... 2013-135162

(51) Int. Cl.
*E04B 1/35* (2006.01)
*E04H 7/06* (2006.01)
(Continued)

(52) U.S. Cl.
CPC ..... *E04B 1/3522* (2013.01); *E04H 5/10* (2013.01); *E04H 7/06* (2013.01); *E04H 7/065* (2013.01);
(Continued)

(58) Field of Classification Search
CPC ..... F17C 2209/221; F17C 2203/0609; F17C 3/022; F17C 2223/0161; F17C 2223/0678; F17C 2223/012; F17C 2201/032; F17C 2201/052; F17C 2201/0109;E04H 7/02; E04H 7/04; E04H 7/06; E04H 7/18; E04H 7/20; E04H 7/22; E04H 7/26; E04H 7/30; B65D 7/38; B65D 7/34; B65D 7/12; B65D 90/08; B65D 15/24; B65D 88/06; B65D 88/08; B23P 11/00; B23P 19/04; B23P 19/10; Y10T 29/49616; Y10T 29/49636
(Continued)

(56) References Cited

U.S. PATENT DOCUMENTS 1,453,983 A * 5/1923 Kerlin ..... B65D 90/38 220/567.2
1,631,051 A * 5/1927 Nichols ..... B65D 90/08 220/4.12
(Continued)

FOREIGN PATENT DOCUMENTS

JP 52-49666 B2 12/1977
JP 7-62924 A 3/1995
WO 2012/137671 A1 10/2012

OTHER PUBLICATIONS

International Search Report mailed Aug. 26, 2014 in PCT/JP2014/066998 (with an English translation) (2 pages).

*Primary Examiner* — Rodney Mintz
(74) *Attorney, Agent, or Firm* — Rothwell, Figg, Ernst & Manbeck, P.C.

(57) ABSTRACT

There is provided a method for constructing a cylindrical tank, including the step of assembling a metal inner tank by individually and sequentially conducting, on an internal side of a PC wall, raising of an inner tank lateral plate by a jack-up unit and welding of a next-stage inner tank lateral plate onto a lower section of the raised inner tank lateral plate, further including the step of installing a guide pair configured to sandwich the raised inner tank lateral plate onto the next-stage inner tank lateral plate that is to be welded therebeneath. As a result, in the case of adopting the
(Continued)

jack-up construction system, it is possible to prevent an inner tank lateral plate from being attached next from falling.

8 Claims, 10 Drawing Sheets

(51) Int. Cl.
*E04H 7/18* (2006.01)
*E04H 5/10* (2006.01)
*F17C 1/02* (2006.01)
*F17C 13/00* (2006.01)

(52) U.S. Cl.
CPC . *E04H 7/18* (2013.01); *F17C 1/02* (2013.01); *F17C 13/004* (2013.01); *F17C 2201/0104* (2013.01); *F17C 2201/0109* (2013.01); *F17C 2201/0119* (2013.01); *F17C 2201/032* (2013.01); *F17C 2201/052* (2013.01); *F17C 2203/011* (2013.01); *F17C 2203/0341* (2013.01); *F17C 2203/0602* (2013.01); *F17C 2203/0629* (2013.01); *F17C 2203/0639* (2013.01); *F17C 2203/0678* (2013.01); *F17C 2203/0695* (2013.01); *F17C 2209/221* (2013.01); *F17C 2209/232* (2013.01); *F17C 2209/234* (2013.01); *F17C 2209/236* (2013.01); *F17C 2209/238* (2013.01); *F17C 2221/033* (2013.01); *F17C 2221/035* (2013.01); *F17C 2223/0153* (2013.01); *F17C 2223/0161* (2013.01); *F17C 2270/0134* (2013.01)

(58) Field of Classification Search
USPC ..... 220/560.05, 560.06, 565, 566, 567.2, 220/62.15, 62.11, 646, 648, 650, 652, 220/653, 679, 683; 52/745.01, 169.7, 52/223.3
See application file for complete search history.

(56) References Cited

U.S. PATENT DOCUMENTS 1,839,578 A * 1/1932 Morton ..... E04H 7/06 29/429
1,842,735 A * 1/1932 Spence ..... B65D 90/08 220/200
1,966,244 A * 7/1934 Hansen ..... B65D 90/08 220/4.12
2,057,682 A * 10/1936 Horton ..... B65D 88/48 220/225
2,216,701 A * 10/1940 Cole ..... E04H 7/06 269/43
2,378,126 A * 6/1945 Blair ..... B65D 90/205 217/4
2,708,012 A * 5/1955 Talcott ..... E04H 7/30 220/565
2,808,097 A * 10/1957 Martin ..... B29C 53/66 156/175
2,866,261 A * 12/1958 Macku ..... E04H 7/06 220/565
2,984,898 A * 5/1961 Svensson ..... E04H 7/06 220/565
2,993,679 A * 7/1961 Morgan ..... E04B 1/3522 254/399
3,131,908 A * 5/1964 Payton ..... E04H 7/06 254/89 H
3,199,839 A * 8/1965 Linder ..... B66F 3/46 254/103
3,554,491 A * 1/1971 Tegtmeier ..... E04H 7/06 254/134
3,966,533 A * 6/1976 Goldsworthy ..... E04H 7/02 156/379.8
4,044,517 A * 8/1977 Schroter ..... B65D 90/06 220/592.24
4,062,468 A * 12/1977 Bongiovanni ..... B65D 90/06 220/567.2
4,067,097 A * 1/1978 Okamoto ..... E04H 7/06 29/429
4,177,915 A * 12/1979 Blankenburg ..... E04H 7/06 228/184
4,197,689 A * 4/1980 DeMuth ..... E04H 7/30 52/123.1
4,207,716 A * 6/1980 Moldrup ..... E04H 7/20 52/223.3
4,453,351 A * 6/1984 Moore ..... E04H 7/30 52/192
4,610,376 A * 9/1986 Regent ..... E04H 7/30 220/4.17
4,989,751 A * 2/1991 Gillett ..... E04H 7/30 220/565
6,282,863 B1 * 9/2001 Christian ..... E04H 7/30 182/128
6,715,243 B1 * 4/2004 Fons ..... E04H 7/30 220/4.12
9,441,389 B2 * 9/2016 Shiomi ..... E04H 7/06
2008/0224022 A1 * 9/2008 Kreiner ..... E04G 11/22 249/192
2008/0302804 A1 * 12/2008 Simmons ..... F17C 3/022 220/560.05
2010/0154332 A1 * 6/2010 Shockley ..... E04C 3/22 52/223.3
2013/0319552 A1 * 12/2013 Svarczkopf ..... B65D 13/00 137/565.01
2014/0103046 A1 * 4/2014 Hata ..... F17C 3/025 220/560.1
2014/0138389 A1 * 5/2014 Allen ..... B65D 90/08 220/565
2014/0348619 A1 * 11/2014 Granger ..... B65B 23/00 414/399
2015/0197953 A1 7/2015 Shiomi et al.
2015/0267434 A1 9/2015 Shiomi et al.
2016/0097211 A1 4/2016 Deguchi et al.

* cited by examiner

METHOD FOR CONSTRUCTING CYLINDRICAL TANK

This application is a continuation application based on a PCT Patent Application No. PCT/JP2014/066998, filed on Jun. 26, 2014, whose priority is claimed on Japanese Patent Application 2013-135162, filed on Jun. 27, 2013. The contents of both the PCT Application and the Japanese Application are incorporated herein by reference.

TECHNICAL FIELD

The present disclosure relates to a method for constructing a cylindrical tank.

RELATED ART

Cylindrical tanks with a dual-shell structure that have an inner tank and an outer tank are used for storing cryogenic liquid such as LNG (liquefied natural gas) and LPG (liquefied petroleum gas). Patent Document 1 discloses a cylindrical tank that has an inner tank made of metal and an outer tank made of concrete.

Patent Document 1 discloses a method of constructing a metal inner tank and a concrete outer tank at the same time in order to make the construction period of the cylindrical tank shorter. To be more specific, jack stands are erected on a base portion of the outer tank, and are then caused to support jack-up units at a predetermined height (see FIG. 4(*b*) of Patent Document 1). When a sidewall of the outer tank is built, an inner tank roof and an outer tank roof are assembled on the base portion of the outer tank. Subsequently, while the inner tank roof and the outer tank roof are being raised by use of the jack-up unit, plural stages of inner tank lateral plates are attached to the inner tank roof one by one from the uppermost level to the lowermost level. As a result, the metal inner tank and the concrete outer tank are simultaneously constructed.

CITATION LIST

Patent Document 1: Japanese Unexamined Patent Application, First Publication No. H07-62924

SUMMARY OF DISCLOSURE

In the conventional technique that adopts the aforementioned jack-up construction system, into the space beneath an inner tank lateral plate that has been raised by the jack-up unit, an inner tank lateral plate to be attached next is taken through a construction site entrance. To be more specific, by use of hoist devices (denoted with reference numeral 6-2 in FIG. 6 of Patent Document 1) made of a rail and a hoist, inner tank lateral plates taken in through the construction site entrance are transferred to a predetermined welding position. To a lower section of the raised inner tank lateral plate, the next-stage inner tank lateral plate is welded.

However, around the next-stage inner tank lateral plate that is to be attached to the lower section of the raised inner tank lateral plate, there are few or no structures usable for preventing the inner tank lateral plate from falling. Therefore, when a next-stage inner tank lateral plate is taken in through the construction site entrance, it is necessary to pay close attention to prevent the inner tank lateral plate from falling.

The present disclosure has been achieved in view of the above problem, and has an object to provide a method for constructing a cylindrical tank that, in the case of adopting the jack-up construction system, is capable of securely preventing an inner tank lateral plate to be attached next from falling without requiring complicated operations.

To solve the above problem, a first aspect of the present disclosure is a method for constructing a cylindrical tank, including the step of assembling a metal inner tank by individually and sequentially conducting, on an internal side of a concrete outer tank, raising of an inner tank lateral plate by a jack-up unit and welding of a next-stage inner tank lateral plate onto a lower section of the raised inner tank lateral plate, further including the step of installing a guide pair for sandwiching the raised inner tank lateral plate onto the next-stage inner tank lateral plate that is to be welded therebeneath.

With the guide pair for sandwiching the raised inner tank lateral plate being installed on the next-stage inner tank lateral plate that is to be welded therebeneath, the raised inner tank lateral plate (a structure immediately above the next-stage inner tank lateral plate) is used to make it possible to prevent the next-stage inner tank lateral plate to be attached to the lower section of the raised inner tank lateral plate from falling.

A second aspect of the present disclosure is the first aspect as set forth above, further including the step of transferring the next-stage inner tank lateral plate in a circumferential direction of the tank while the raised inner tank lateral plate is sandwiched between the guide pair.

While the raised inner tank lateral plate is sandwiched between the guide pair, the next-stage inner tank lateral plate is transferred in the circumferential direction of the tank, to thereby utilize the raised inner tank lateral plate as a transfer rail. As a result, it is possible to easily transfer the next-stage inner tank lateral plate in the circumferential direction of the tank along the raised inner tank lateral plate.

A third aspect of the present disclosure is the second aspect as set forth above, wherein the guide pair has guide rollers that roll on plate surfaces of the raised inner tank lateral plate.

With the guide pair having guide rollers, it is possible to decrease the friction and noise produced between the guide pair and the raised inner tank lateral plate when the next-stage inner tank lateral plate is transferred in the circumferential direction of the tank.

A fourth aspect of the present disclosure is the second or third aspect as set forth above, wherein a plate surface of the raised inner tank lateral plate that faces an internal side of the tank is provided with a key nut, the method further including the step of installing a first guide member out of a pair of guide members that constitute the guide pair at a level below the key nut, the first guide member being opposed to a plate surface of the raised inner tank lateral plate that faces the internal side of the tank.

In the case where a key nut used for joining the adjacent inner tank lateral plates is provided on the plate surface of the inner tank lateral plate that faces the internal side of the tank, the first guide member is installed at a level below the key nut. Thereby, interference between the first guide member and the key nut is avoided, and a smooth transfer of the next-stage inner tank lateral plate in the circumferential direction of the tank is available.

A fifth aspect of the present disclosure is the fourth aspect as set forth above, further including the step of installing a second guide member out of the pair of the guide members that constitute the guide pair so as to extend to a level above the first guide member, the second guide member being opposed to a plate surface of the raised inner tank lateral plate that faces an external side of the tank.

With the second guide member that guides the plate surface of the inner tank lateral plate that faces the external side of the tank being extended to a level above the first guide member, it is possible to secure a wide guide area, where no key nut is provided, in the outward-facing plate surface that faces the external side of the tank.

Effects of the Disclosure

According to the present disclosure, in a method for constructing a cylindrical tank that adopts the jack-up construction system, it is possible to securely prevent an inner tank lateral plate to be attached next from falling without requiring complicated operations.

BEST MODE FOR CARRYING OUT THE DISCLOSURE

Hereunder is a description of a method for constructing a cylindrical tank according to the present disclosure, with reference to the drawings. In the following description, a ground-type PC (prestressed concrete) double-shell tank configured to store LNG will be used as a cylindrical tank, by way of example.

Figure 1:
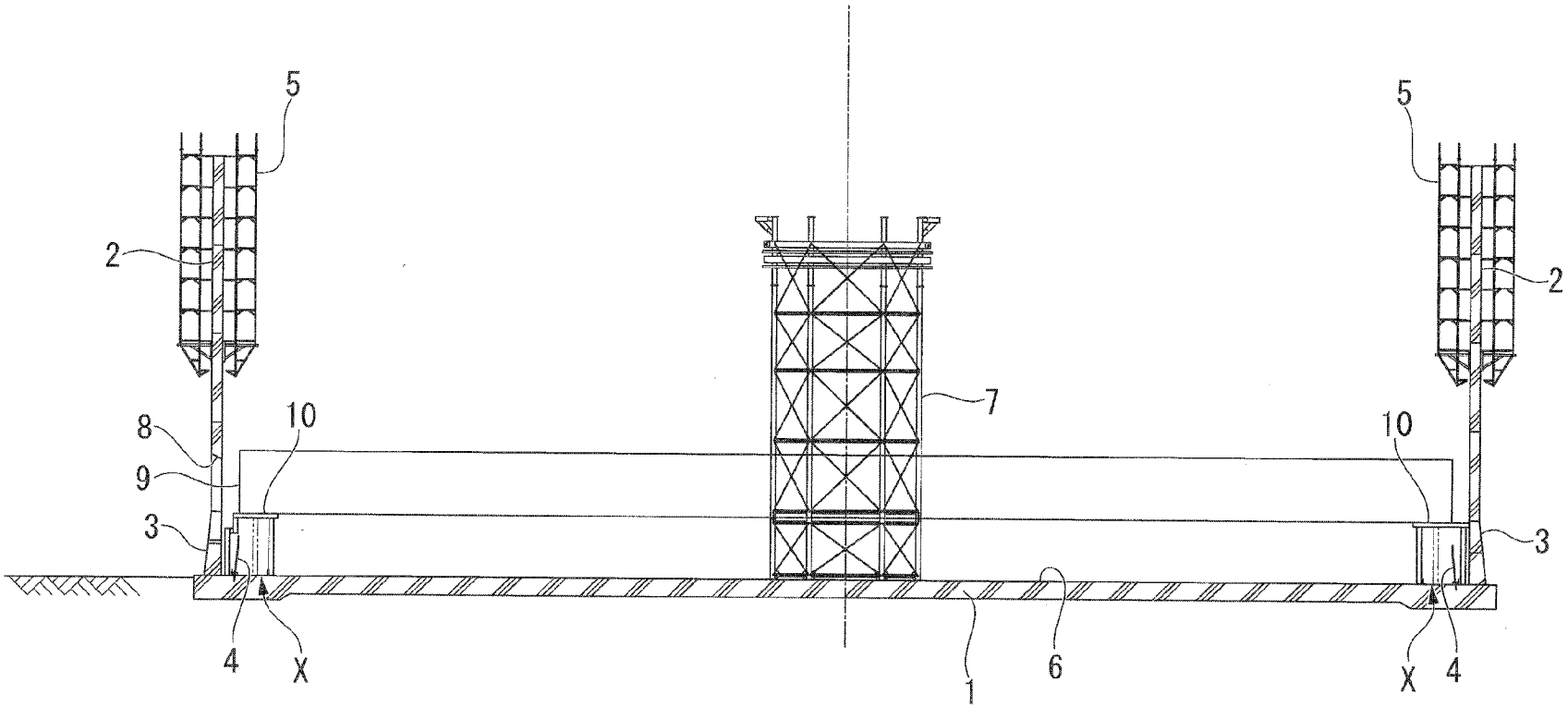
FIG. 1 is a diagram showing a first step of a construction method according to an embodiment of the present disclosure.

As shown in FIG. 1, a substantially disc-like base plate 1 is firstly constructed in the present method. On an outer circumferential edge of the base plate 1, there is erected a base part 3 on which a PC wall 2 (outer tank) is to be assembled. Along an internal side of the base part 3, inner tank anchor straps 4 are installed. Then, the PC wall 2 is formed on the base part 3 by casting. For the formation of the PC wall 2 by casting, a foot scaffold 5 is provided on both of the internal side and the external side, and mold (not shown in the figure) is installed.

Subsequently, a base portion liner 6 is laid on the base plate 1. At the central portion of the base plate 1, a roof stand 7 is assembled. At a base end of the PC wall 2, a construction site entrance 8 through which the inner tank lateral plates 9 are to be taken in one by one is formed. Along an internal side of the base end of the PC wall 2, a plurality of portal stands 10 for assembling the inner tank lateral plates are installed. The portal stands 10 are installed so as to bridge across an annular area X, an area in which a cylindrical inner tank made of assembled inner tank lateral plates 9 is finally put down onto the base plate 1.

Figure 2:
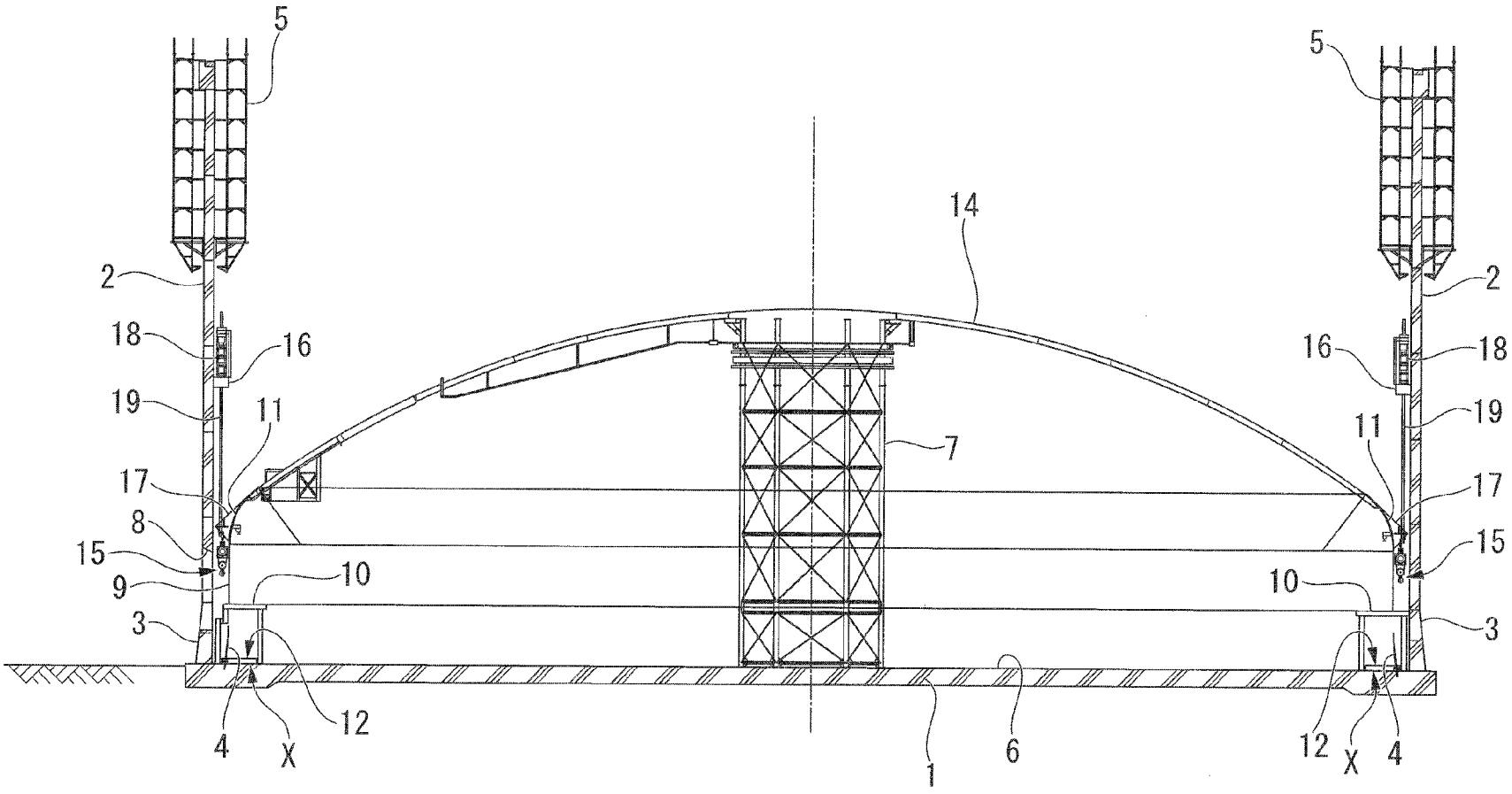
FIG. 2 is a diagram showing a second step of the construction method according to the embodiment of the present disclosure.

Subsequently, in the present technique, as shown in FIG. 2, the inner tank lateral plates 9 are placed on the portal stands 10. The adjacent inner tank lateral plates 9 are welded to be joined in the circumferential direction so as to have a generally cylindrical shape. Furthermore, a knuckle plate 11 is fit together with an upper edge of the joined inner tank lateral plates 9. Furthermore, in an annular area X beneath the portal stands 10, components 12 of an annular section 13 (see FIG. 3) such as perlite concrete blocks or structural lightweight concrete blocks are temporarily laid. Furthermore, an inner tank roof 14 is assembled on the roof stand 7. Furthermore, with an outer circumferential edge of the inner tank roof 14, the joined inner tank lateral plates 9 are fit together via the knuckle plate 11.

Subsequently, in the present technique, on the PC wall 2 above the knuckle plate 11, in an inner-outer tank gap 15 (gap between the PC wall 2 and the inner tank lateral plates 9) above the base plate 1, a plurality of hanging-side jack stands 16 (hanging points) are installed along the circumferential direction of the tank. The hanging-side jack stand 16 is provided so as to protrude toward the internal side of the tank substantially horizontally from the PC wall 2 at a predetermined height. The hanging-side jack stand 16 is solidly and detachably fastened and fixed to, for example, an anchor plate embedded in the PC wall 2.

Furthermore, on the knuckle plate 11, there are installed a plurality of knuckle reinforcement members 17 corresponding to the hanging-side jack stands 16. The knuckle reinforcement member 17 protrudes from the knuckle plate 11 toward the inner-outer tank gap 15. The knuckle reinforcement member 17 functions as a hanged-side stand. Over the space between the hanging-side jack stand 16 and the knuckle reinforcement member 17, a jack-up unit 18 is installed. The jack-up unit 18 is a center hole jack. The main unit of the device is installed on the hanging-side jack stand 16, and a lower end of a jack-up rod 19 is attached to the knuckle reinforcement member 17.

Figure 3:
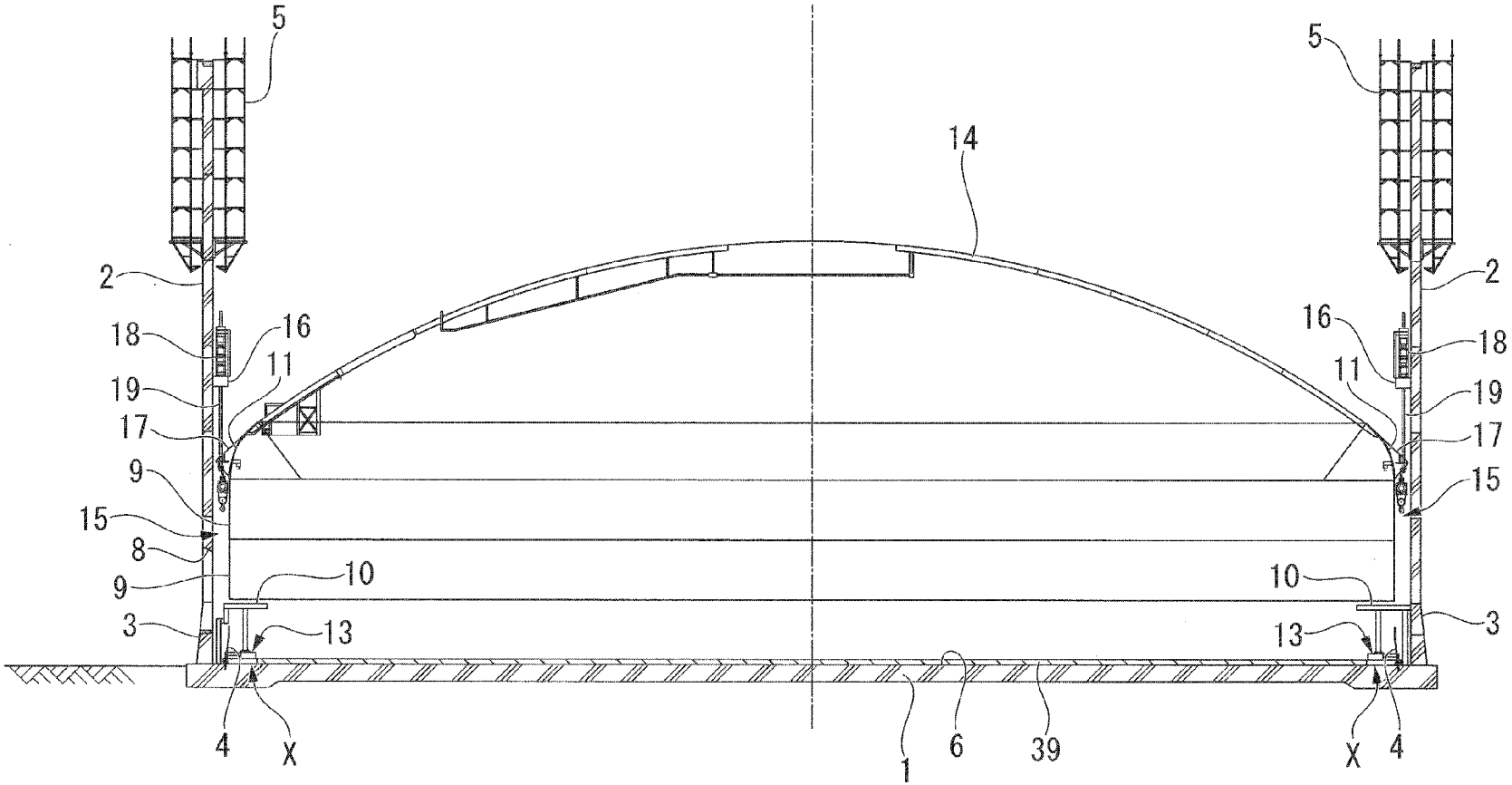
FIG. 3 is a diagram showing a third step of the construction method according to the embodiment of the present disclosure.

After the jack-up units 18 are installed as described above, the roof stand 7 is removed and the knuckle plate 11 is hanged up by use of the jack-up units 18 as shown in FIG. 3. Thereby, the inner tank lateral plate 9 is raised. After the inner tank lateral plate 9 is raised by use of the jack-up units 18 by a single stroke of the jack-up rod 19 (which corresponds to a vertical width of a single inner tank lateral plate 9, in the present embodiment), a next-stage inner tank lateral plate 9 is carried into the space that this jacking-up has formed beneath the jacked-up inner tank lateral plate 9. Note that the jack-up rod 19 has a structure that is dividable into a plurality of rods. If the jack-up rod 19 interferes with the foot scaffold 5, the top section of the jack-up rod 19 is divided to make it shorter.

Figure 4:
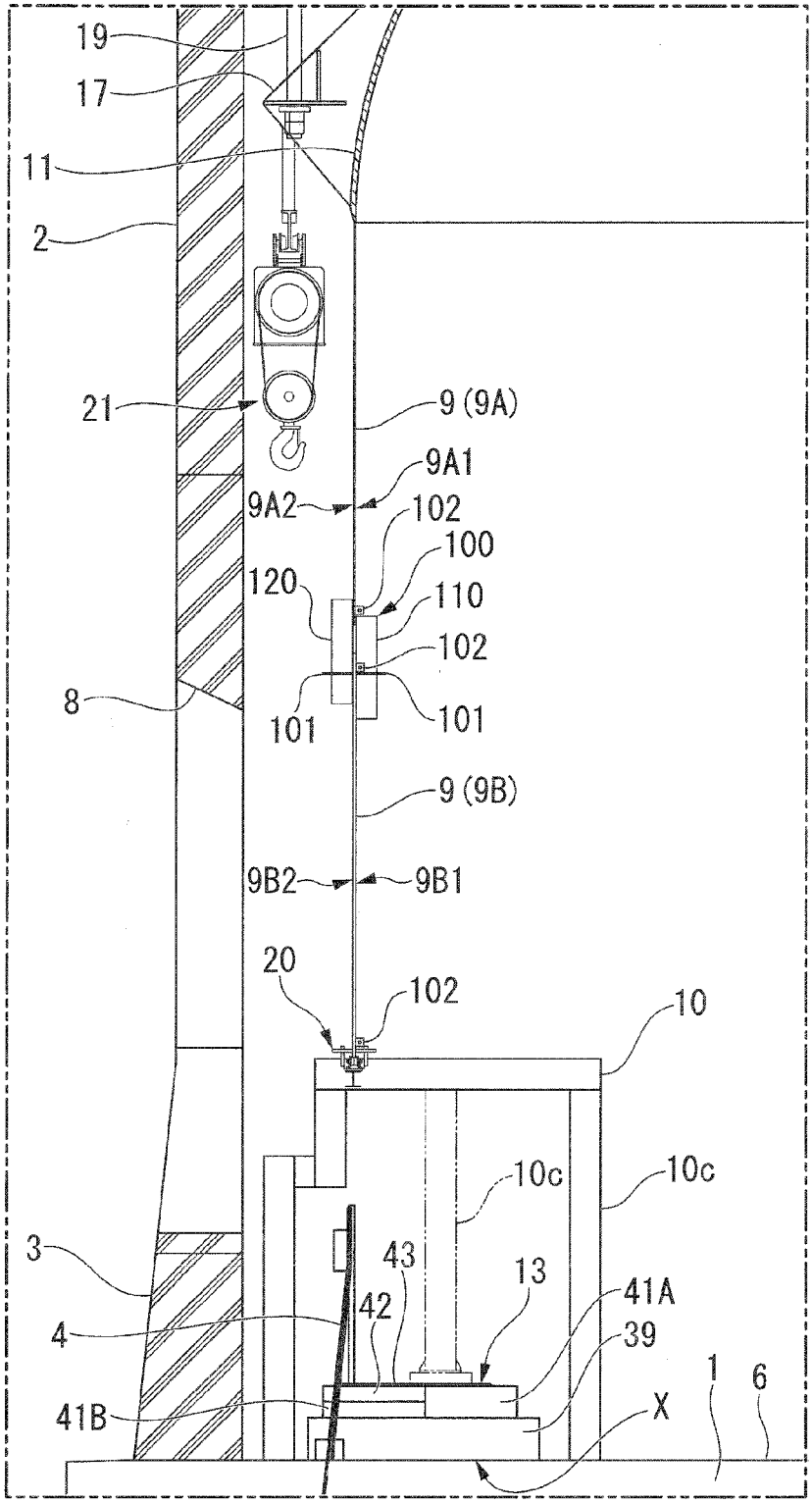
FIG. 4 is a diagram showing a state in which an inner tank lateral plate is supported in the embodiment of the present disclosure.

As shown in FIG. 4, the next-stage inner tank lateral plate 9 (sometimes referred to as inner tank lateral plate 9B), which has been carried in through the construction site entrance 8, is placed onto the portal stands 10. It is preferable that the portal stand 10 be provided with a roller unit 20 configured to transfer an inner tank lateral plate 9B in the circumferential direction. The inner tank lateral plate 9B is hanged up by trolley cranes 21 provided in the inner-outer tank gap 15, is placed on the roller units 20 in an erect posture, and then is transferred to a predetermined welding position.

On the inner tank lateral plate 9B, guide pairs 100 are installed. The guide pair 100 is a member configured to sandwich the inner tank lateral plate 9 lifted by jacking up (hereinafter, sometimes referred to as inner tank lateral plate 9A), to thereby prevent an inner tank lateral plate 9B, which is to be welded to a lower section of the inner tank lateral plate 9A, from falling. The guide pair 100 is made of a pair of guide members (a first guide member 110, a second guide member 120). The first guide member 110 is installed on one side of the inner tank lateral plate 9B. The second guide member 120 is installed on a second surface of the inner tank lateral plate 9B.

Figure 5:
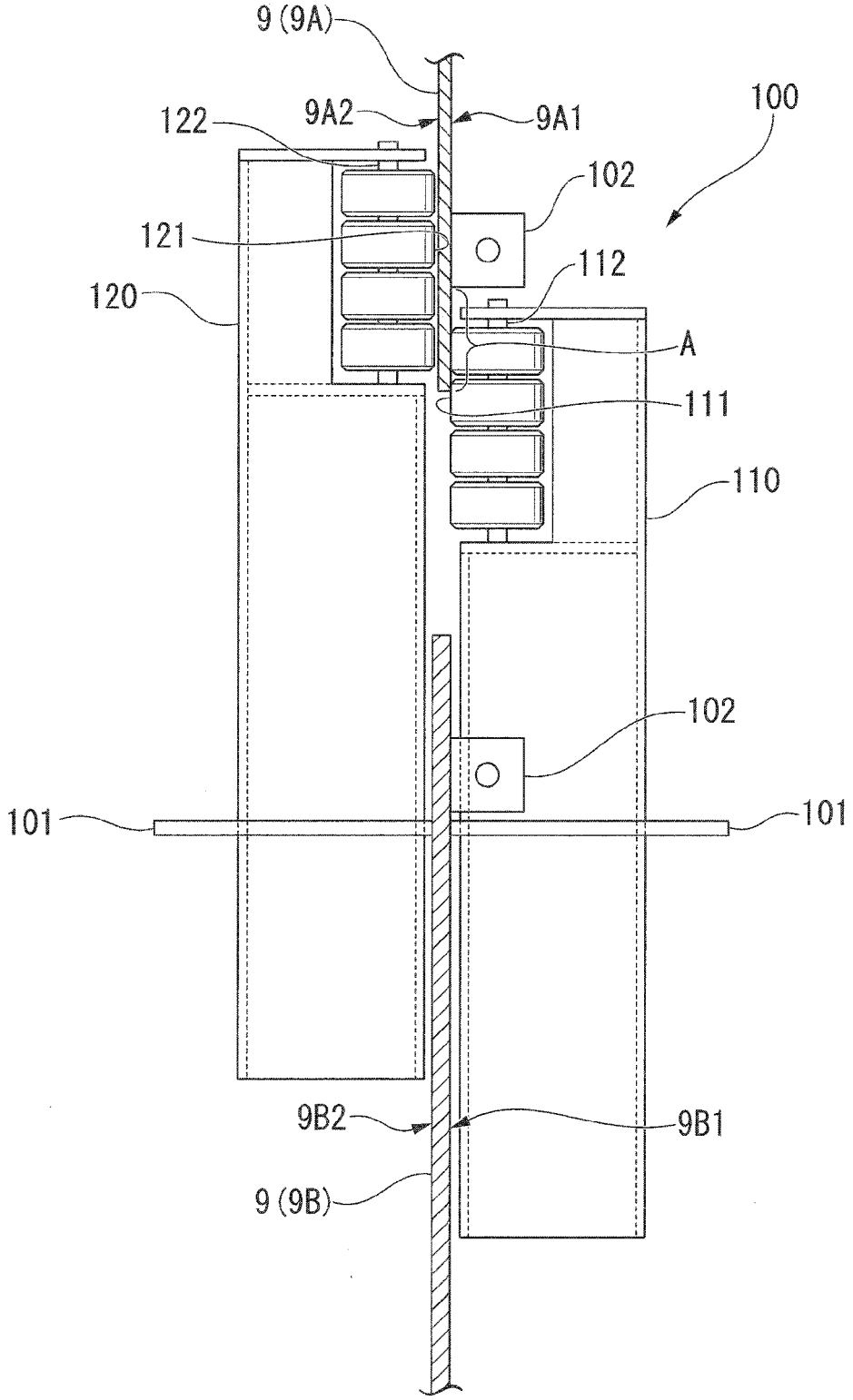
FIG. 5 is an enlarge view showing a structure of the main part of a guide pair according to the embodiment of the present disclosure.
Figure 6:
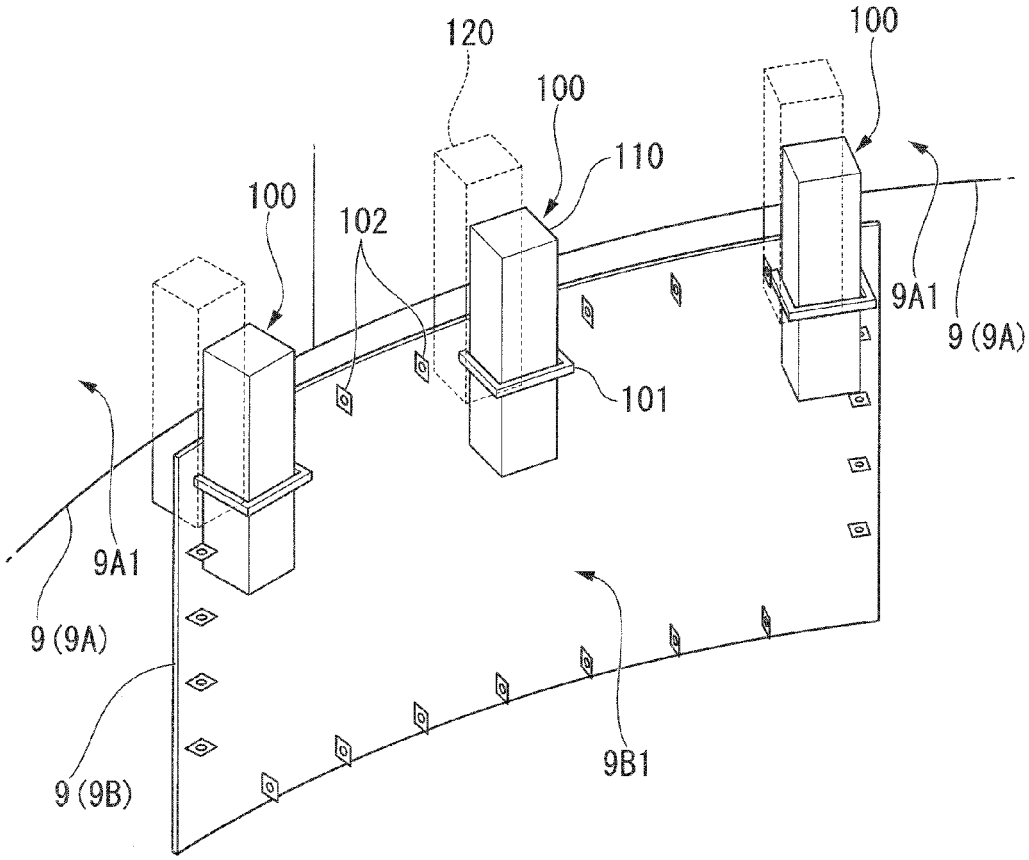
FIG. 6 is a diagram showing an arrangement of the guide pairs according to the embodiment of the present disclosure.

As shown in FIG. 5, the first guide member 110 is opposed to a plate surface of the inner tank lateral plate 9A (inward-facing plate surface 9A1), which faces the internal side of the tank. The first guide member 110 is attached, via a horseshoe 101, to a plate surface of the inner tank lateral plate 9B (inward-facing plate surface 9B1), which faces the internal side of the tank. As shown in FIG. 6, the horseshoe 101 is made of a substantially-U-shaped portal steel material. This horseshoe 101 is welded to the inner tank lateral plate 9B, and the first guide member 110 is fixed to the inner tank lateral plate 9B. Note that only one side of the horseshoe 101 has welded to the inner tank lateral plate 9B. As a result, in a later step, it is possible to easily remove the horseshoe 101 by use of a hammer or the like.

As shown in FIG. 5, the first guide member 110 has guide rollers 111 that roll on the inward-facing plate surface 9A1 of the inner tank lateral plate 9A. The guide rollers 111 have a rotation shaft 112 that extends vertically. The rotation shaft 112 is supported rotatably in the first guide member 110. In an upper end of the first guide member 110 that extends vertically, the guide rollers 111 are rotatable about the rotation shaft 112.

On the inward-facing plate surface 9A1 of the inner tank lateral plate 9A, there is provided a key nut 102. Furthermore, on the inward-facing plate surface 9B 1 of the inner tank lateral plate 9B, there is provided a key nut 102 as well. As joints when the inner tank lateral plates 9 are welded, the key nuts 102 are used for welding the adjacent inner tank lateral plates 9 to each other in advance.

To the key nut 102, there is attached a jig that, at the time of welding, positions and fixes the adjacent inner tank lateral plates 9. For example, as shown in FIG. 6, a plurality of key nuts 102 are provided along four edges of the inner tank lateral plate 9 that function as welding lines.

As shown in FIG. 5, the first guide member 110 opposed to the inward-facing plate surface 9A1 of the inner tank lateral plate 9A is located at a level below the key nuts 102 of the inner tank lateral plate 9A. From a lower end of the inner tank lateral plate 9A to the key nuts 102 provided along the lower end, there is formed a flat plane section A with a predetermined width. The first guide member 110 is opposed to the flat plane section A at a level below the key nuts 102. Namely, the guide rollers 111 of the first guide member 110 roll on the flat plane section A.

On the other hand, the second guide member 120 is opposed to a plate surface of the inner tank lateral plate 9A (outward-facing plate surface 9A2), which faces an external side of the tank. The second guide member 120 is attached, via a horseshoe 101, to a plate surface of the inner tank lateral plate 9B (outward-facing plate surface 9B2), which faces the external side of the tank. The horseshoe 101 is made of a portal steel material similarly to the case of the one on the side of the first guide member 110. This horseshoe 101 is welded to the inner tank lateral plate 9B, and the second guide member 120 is fixed to the inner tank lateral plate 9B. Note that only one side of the horseshoe 101 has welded to the inner tank lateral plate 9B, similarly to the case of the one on the side of the first guide member 110.

The second guide member 120 has guide rollers 121 that roll on the outward-facing plate surface 9A2 of the inner tank lateral plate 9A. The guide rollers 121 have a rotation shaft 122 that extends vertically. The rotation shaft 122 is supported rotatably in the second guide member 120. In an upper end of the second guide member 120 that extends vertically, the guide rollers 121 are rotatable about the rotation shaft 122.

The outward-facing plate surface 9A2 of the inner tank lateral plate 9A is not provided with any key nuts 102. The second guide member 120 opposed to the outward-facing plate surface 9A2 of the inner tank lateral plate 9A is installed at a level above the first guide member 110. The second guide member 120 is opposed to a rear side of the key nuts 102 provided on the inner tank lateral plate 9A. Namely, the guide rollers 121 of the second guide member 120 roll at a height equivalent to that of the key nuts 102.

By the way, an upper stage of the inner tank lateral plate 9 is thin while a lower stage thereof is gradually thicker so as to be capable of withstanding weight, water pressure, and the like. As shown in FIG. 5, the inner tank lateral plate 9A has a thickness thinner than that of the inner tank lateral plate 9B. As for the guide rollers 121 of the second guide member 120, the guide roller 121 at an upper position protrudes further so as to compensate for the difference in thickness in the vertical direction. Note that, even if there is backlash to some degree between the guide pair 100 and the inner tank lateral plate 9, this has little influence on the capability of fall prevention and transfer of the inner tank lateral plates 9.

A plurality of guide pairs 100 with the above structure are installed along the upper end of the inner tank lateral plate 9B, as shown in FIG. 6. In the present embodiment, the guide pairs 100 are installed at three locations along the upper end of the inner tank lateral plate 9B. In consideration of balance, the guide pairs 100 are installed so that the adjacent guide pairs 100 are evenly spaced. Note that the size of, the number of, the space between, and the like of the guide pairs 100 can be appropriately modified depending on the size and weight of the inner tank lateral plate 9B.

After installation of the guide pairs 100 as described above, an inner tank lateral plate 9B, which has been carried in through the construction site entrance 8 shown in FIG. 4, is transferred in the circumferential direction of the tank. In the present technique, while the inner tank lateral plate 9A raised by jacking up is being sandwiched between the guide pairs 100, an inner tank lateral plate 9B to be welded therebeneath is transferred in the circumferential direction of the tank. Thereby, the inner tank lateral plate 9A is utilized as a transfer rail. The inner tank lateral plates 9A are welded into a generally cylindrical shape. With the utilization of the inner tank lateral plates 9A as a transfer rail, it is possible to secure transfer tracks for the inner tank lateral plates 9B over the whole circumference of the tank without installing additional rail members for transferring the inner tank lateral plates 9B.

Furthermore, with the utilization of the inner tank lateral plates 9A as a transfer rail, it is possible to transfer an inner tank lateral plate 9B along the inner tank lateral plate 9A as a welding target. This makes it easy to vertically position the welding positions of the inner tank lateral plates 9A, 9B. The guide pair 100 has the guide rollers 111, 121 that roll on the plate surfaces of the inner tank lateral plate 9A, as shown in FIG. 5. When the inner tank lateral plate 9B is transferred in the circumferential direction of the tank, the guide rollers 111, 121 decrease the friction and noise produced between the guide pair 100 and the inner tank lateral plate 9A. As a result, it is possible to easily transfer the inner tank lateral plate 9B along the inner tank lateral plate 9A in the circumferential direction of the tank.

Furthermore, the inward-facing plate surface 9A1 of the inner tank lateral plate 9A is provided with the key nut 102 for joining the adjacent inner tank lateral plates 9. In the present technique, the first guide member 110 opposed to the inward-facing plate surface 9A1 of the inner tank lateral plate 9A is installed below the key nut 102. This makes it possible for the guide rollers 111 to roll on the flat plane section A below the key nuts 102. Therefore, on the inward-facing plate surface 9A1 of the inner tank lateral plate 9A, smooth transfer of the inner tank lateral plate 9B in the circumferential direction of the tank while avoiding the interference with the key nuts 102 is available.

On the other hand, the outward-facing plate surface 9A2 of the inner tank lateral plate 9A is not provided with any key nuts 102. Therefore, in the present technique, the second guide member 120 opposed to the outward-facing plate surface 9A2 of the inner tank lateral plate 9 is installed above the first guide member 110. This makes it possible for the guide rollers 121 to roll at a height equivalent to that of the key nuts 102. Therefore, in the outward-facing plate surface 9A2 where no key nuts 102 are provided, a contact area between the guide rollers 121 and the outward-facing plate surface 9A2 is greater, to thereby make it possible to secure a wide guide area by the guide rollers 121.

After an inner tank lateral plate 9B is transferred to a predetermined welding position, the inner tank lateral plates 9B adjacent in the circumferential direction of the tank are welded to each other. As shown in FIG. 4, both of the inner side surface and outer side surface of the inner tank lateral plate 9B face space, and have no structures to recline against. However, in the present technique, the guide pairs 100 configured to sandwich an inner tank lateral plate 9A raised by jacking up are installed on an inner tank lateral plate 9B that is to be welded therebeneath, and the raised inner tank lateral plate 9A (the structure immediately above the inner tank lateral plate 9B) is used to prevent the inner tank lateral plate 9B from falling.

If the inner tank lateral plate 9B is to fall to the external side of the tank, the first guide member 110 constituting the guide pair 100 is brought into abutment with the inward-facing plate surface 9A1 of the inner tank lateral plate 9A, to thereby prevent the inner tank lateral plate 9B from falling. If the inner tank lateral plate 9B is to fall to the internal side of the tank, the second guide member 120 constituting the guide pair 100 is brought into abutment with the outward-facing plate surface 9A2 of the inner tank lateral plate 9A, to thereby prevent the inner tank lateral plate 9B from falling. The inner tank lateral plate 9B is not held by the jack-up units 18 unlike the case of the inner tank lateral plate 9A. Therefore, with this installation of the guide pairs 100, it is possible to prevent the inner tank lateral plate 9B from falling.

On the other hand, because held by the jack-up units 18, the inner tank lateral plate 9A is capable of receiving from the inner tank lateral plate 9B a load for fall prevention. Furthermore, because joined to each other in the circumferential direction of the tank, the inner tank lateral plates 9A have a strength in terms of shape as well. Furthermore, for example in the case where a load for fall prevention is applied at the same time from a plurality of inner tank lateral plates 9B, it is possible to easily limit the sway (positional displacement) of the inner tank lateral plate 9A caused by the load, if the inner tank lateral plate 9A, the knuckle plate 11, or the like is provided with a space keeper that is to be brought into abutment with the PC wall 2 to maintain the gap between the PC wall 2 and the inner tank lateral plate 9A.

Welding the inner tank lateral plates 9B adjacent to each other in the circumferential direction of the tank into a generally cylindrical shape eliminates the possibility that the inner tank lateral plate 9B will fall. Therefore, the guide pairs 100, which have become unnecessary, are removed. The first guide member 110 and the second guide member 120 are both attached, with wedges or the like, to the only one side of the horseshoes 101 which has welded. Therefore, with the wedge being struck in the reverse direction with a hammer or the like, it is possible to easily remove the guide pair 100. Note that the removed guide pairs 100 are reused for fall prevention and transfer of the inner tank lateral plate 9B to be carried in next.

After the inner tank lateral plates 9B are joined in the circumferential direction of the tank, an upper end thereof and a lower end of the inner tank lateral plate 9A are welded. Subsequently, the inner tank lateral plates 9 united by this welding is jacked up by the jack-up units 18. Into the space produced beneath the inner tank lateral plate 9A by the jacking up, a next-stage inner tank lateral plate 9B is carried, and the removed guide pairs 100 are installed thereon. Thus, the raising of each of the plurality of an inner tank lateral plate 9 by the jack-up units 18 and the welding of a next-stage inner tank lateral plate 9B to a lower section of the previous raised inner tank lateral plate 9A are individually and sequentially conducted.

During this working process, the cold insulation work on the annular section 13 is done beneath the portal stands 10.

The cold insulation work on the annular section 13 is done as follows. Perlite concrete blocks 41A, 41B and structural lightweight concrete blocks 42 are assembled on a base portion cold resistance relaxation material 39. Thereonto, an annular plate 43 is attached. Because the annular section 13 is a member that finally supports the assembled inner tank lateral plates 9, the annular plate 43 therefor is formed thick, and a cold insulation structure therefor is formed of hard material such as concrete blocks.

Figure 7:
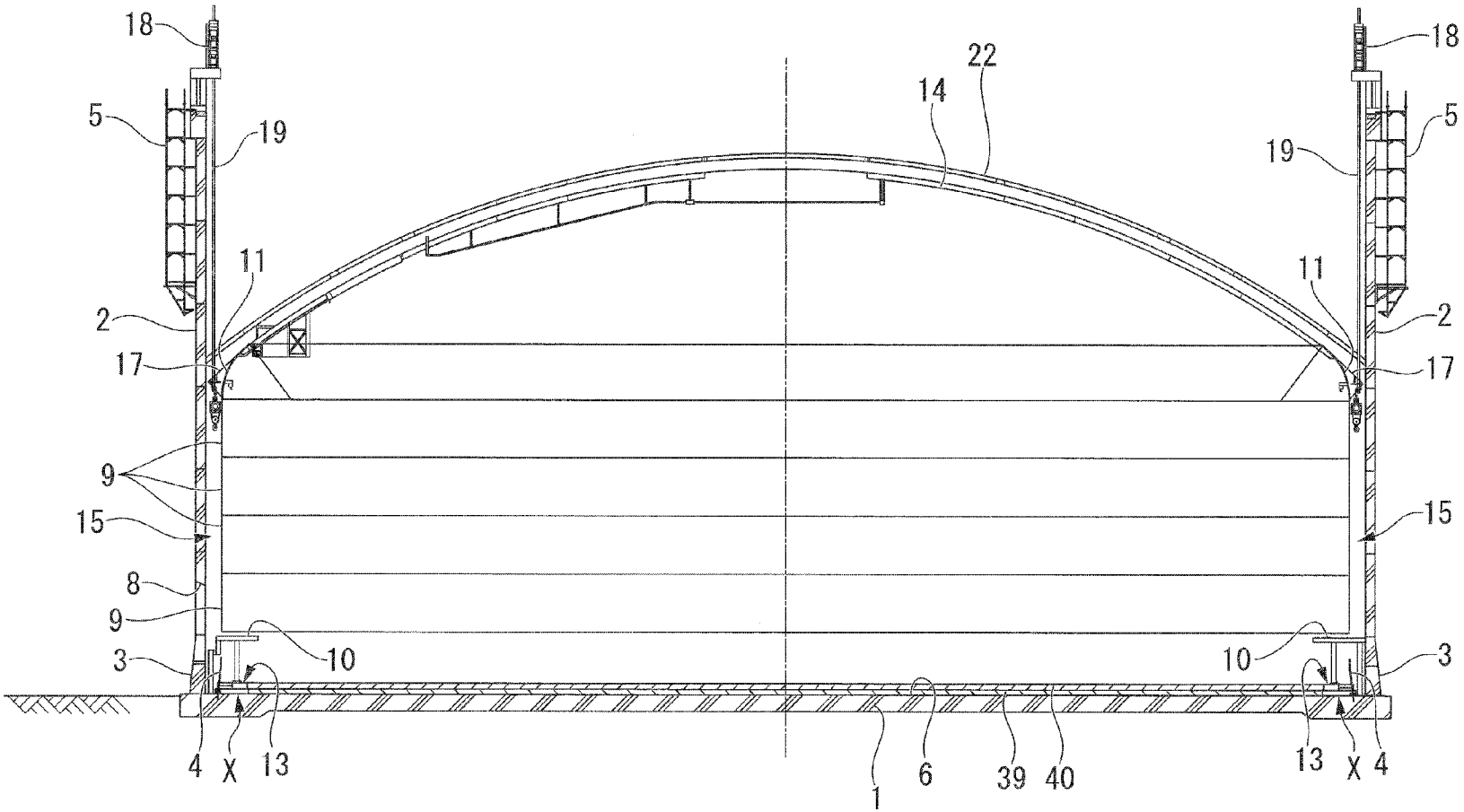
FIG. 7 is a diagram showing a fourth step of the construction method according to the embodiment of the present disclosure.

After completion of the cold insulation work on the annular section 13, leg portions 10*c*, which have been arranged in an area of the tank more inner than the annular section 13, is relocated on the annular section 13. With this relocation, no interfering entity is present in the area of the tank inner than the annular section 13. Therefore, it is possible to do the cold insulation work on a central section of the base plate 1. In the cold insulation work on the central section, foam glass 40 is placed onto the base portion cold resistance relaxation material 39 as shown in FIG. 7. Then, on top of that, perlite concrete blocks (not shown in the figure) and an inner tank bottom plate (not shown in the figure) are laid in this order.

Subsequently, as shown in FIG. 7, an outer tank roof 22 is assembled on the inner tank roof 14. The outer tank roof 22 is coupled to the inner tank roof 14 with coupling members (not shown in the figure), and hence, is formed integrally with the inner tank roof 14. When the assembly of the PC wall 2 is completed, the jack-up units 18 are installed on its top to change the hanging points. On the portal stands 10, annularly-arranged inner tank lateral plates 9 are welded to each other, and also vertically-aligned inner tank lateral plates 9 are welded to each other. Thereby, the inner tank lateral plates 9 are integrally formed into a cylindrical shape. Thus, with the raising of an inner tank lateral plate 9 by the jack-up units 18 and the attachment of the raised inner tank lateral plate 9 to a next-stage inner tank lateral plate 9, which is located therebeneath, being individually and sequentially conducted, the inner tank lateral plates 9 are attached from the uppermost level to the lowermost level in order.

Figure 8:
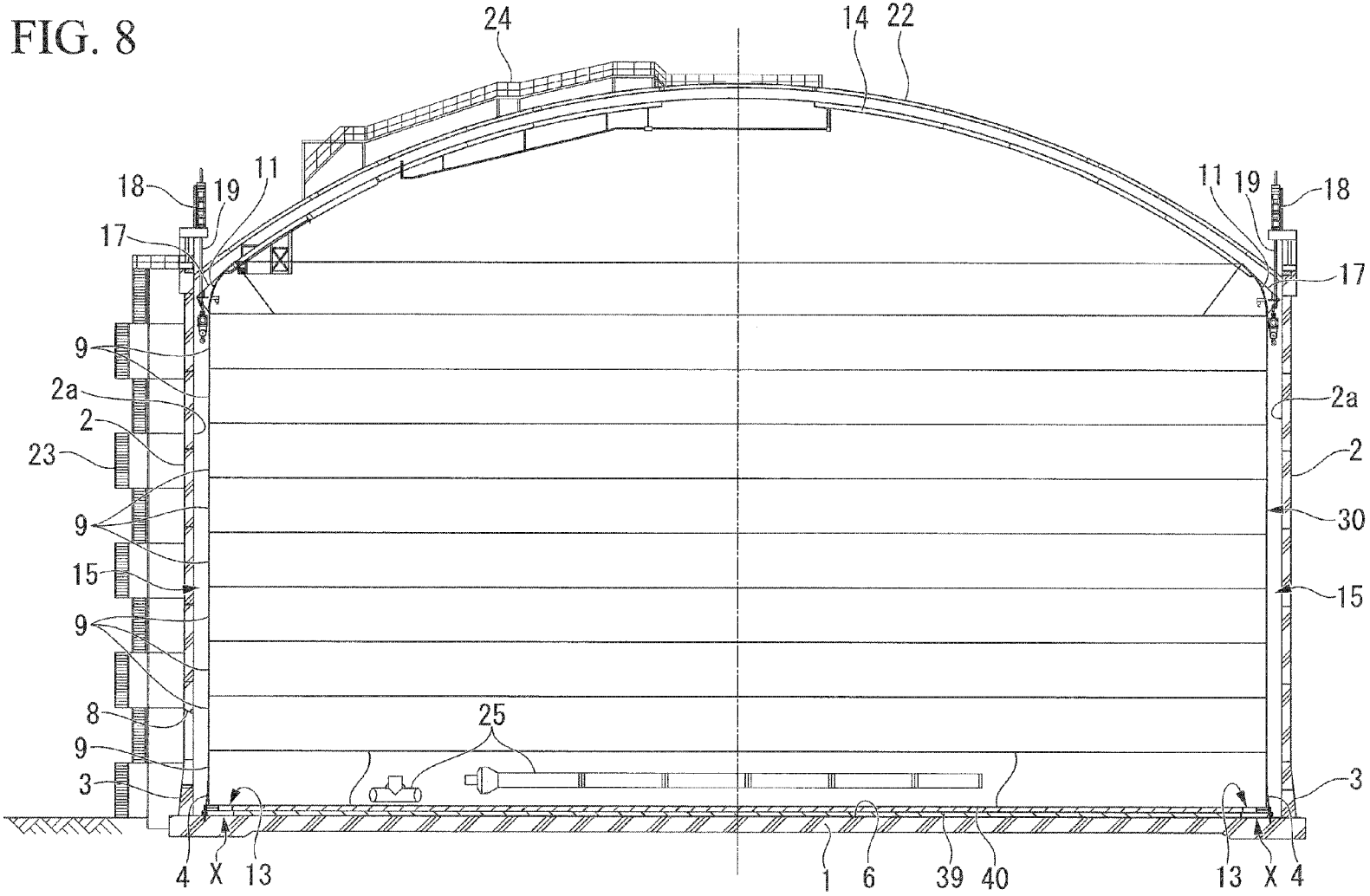
FIG. 8 is a diagram showing a fifth step of the construction method according to the embodiment of the present disclosure.

As shown in FIG. 8, after completion of attachment of the inner tank lateral plates 9 to the lowermost level, the portal stands 10 are removed. Then, the lower end of the inner tank lateral plates 9 in the lowermost level is brought down onto the annular section 13, and is attached to the inner tank anchor straps 4 installed on the base plate 1. As a result, an inner tank 30 is completed. Furthermore, the outer tank roof 22, which has been jacked up together with the inner tank roof 14, has its coupling to the inner tank roof 14 with the coupling members (not shown in the figure) released, and is then settled on the upper end of the PC wall 2 that has been assembled to its uppermost level. Furthermore, to an internal wall surface of the PC wall 2, a lateral liner 2*a* is stuck. A staircase 23 is provided on the outside of the PC wall 2 for going up and down. The outer tank roof 22 is provided with a roof staircase 24. Furthermore, a pump barrel 25 is carried into the tank.

After that, the knuckle reinforcement members 17 are cut off, and the jack-up units 18 are removed. After that, tensing work is done on the PC wall 2. Then, after the construction site entrance 8 is closed and the pump barrel 25 is installed, water is poured in and a pressure/airtight test is conducted.

Figure 9:
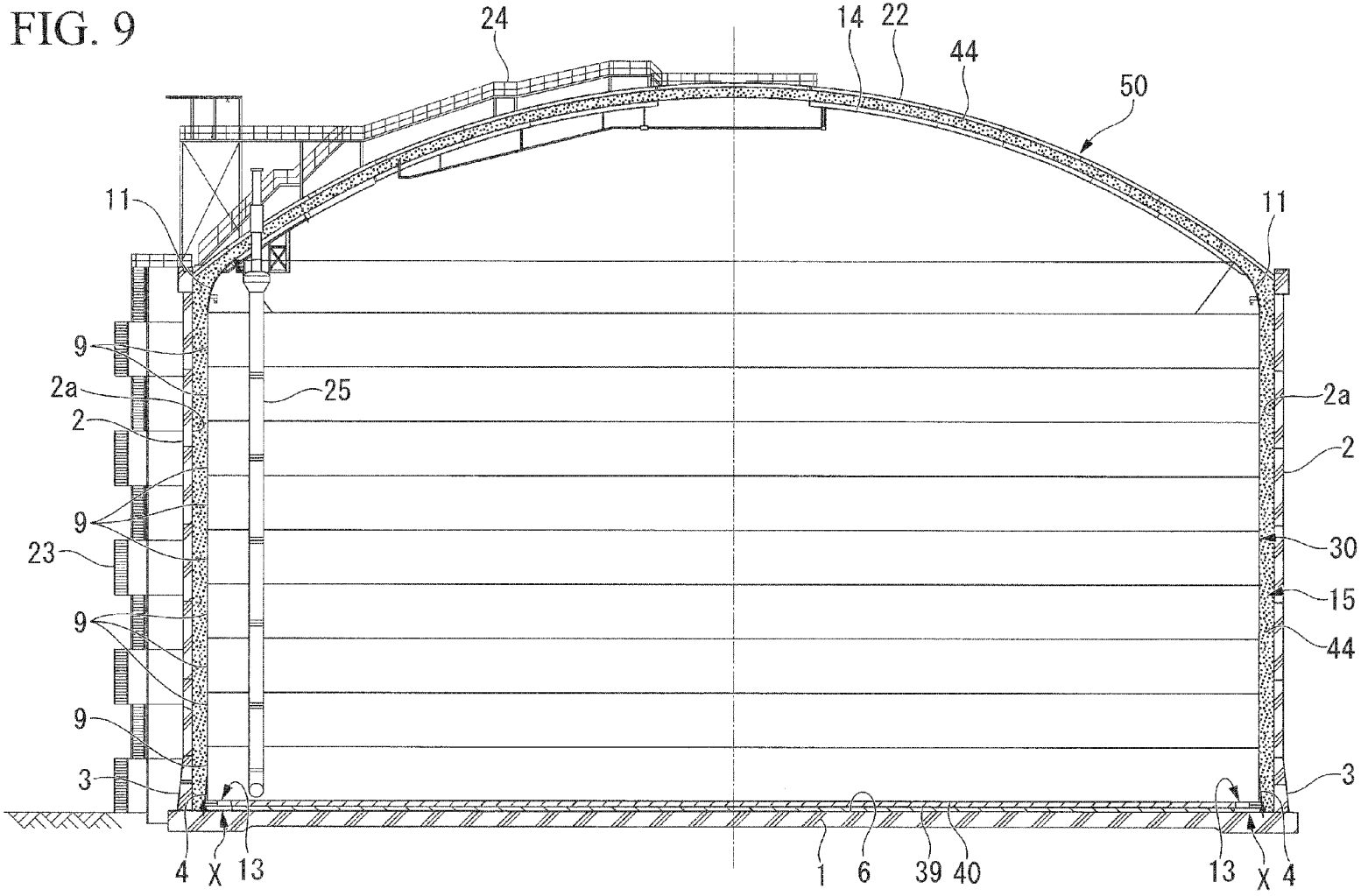
FIG. 9 is a diagram showing a sixth step of the construction method according to the embodiment of the present disclosure.

Finally, as shown in FIG. 9, a cold insulation material 44 is arranged in the inner-outer tank gap 15, and a cold insulation material 44 is also arranged on the rear side of the inner tank roof 14. Thus, cold insulation work is done. After that, through paint work and cold insulation work on the piping, a cylindrical tank 50 is constructed.

The aforementioned embodiment adopts a technique of a method for constructing a cylindrical tank 50, including the step of assembling a metal inner tank 30 by individually and sequentially conducting, on an internal side of a PC wall 2, raising of an inner tank lateral plate 9 by a jack-up unit 18 and welding of a next-stage inner tank lateral plate 9B onto a lower section of the raised inner tank lateral plate 9A, further including the step of installing a guide pair 100 configured to sandwich the raised inner tank lateral plate 9A onto the next-stage inner tank lateral plate 9B that is to be welded therebeneath. As a result, in the case of adopting the jack-up construction system, it is possible to prevent an inner tank lateral plate 9B to be attached next from falling.

While an embodiment of the prevent disclosure has been described above with reference to the drawings, the present disclosure is not limited to the embodiment. Shapes, combinations, and the like of the components shown in the embodiment are merely exemplary examples, and various modifications based on design requirements and the like can be made without departing from the scope of the disclosure.

Figure 10:
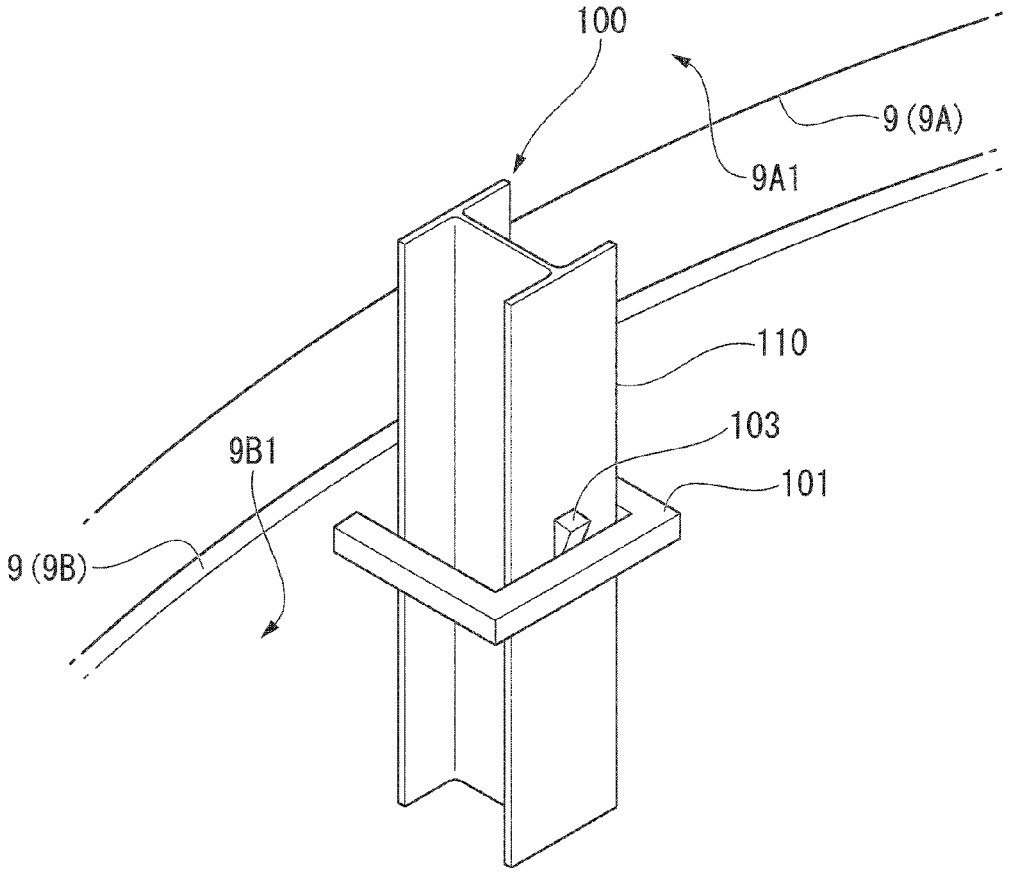
FIG. 10 is a perspective view showing a structure of a guide member according to a second embodiment of the present disclosure.

For example, even if a structure as shown in FIG. 10 is adopted, it is possible to prevent the inner tank lateral plate 9B from falling.

FIG. 10 is a perspective view showing a structure of a guide member (first guide member 110) according to a second embodiment of the present disclosure. In FIG. 10, components the same or similar to those of the aforementioned embodiment are denoted with the same reference symbols.

A guide pair 100 (a second guide member is not illustrated in FIG. 10) does not include the guide rollers 111 of the aforementioned embodiment. To be more specific, a first guide member 110 constituting the guide pair 100 is made of an H-shaped steel itself. The first guide member 110 is inserted into a frame of a horseshoe 101, and a wedge member 103 is struck into the gap. Thereby, it is possible to easily attach the first guide member 110 to an inward-facing plate surface 9B1 of an inner tank lateral plate 9B. With this structure, it is possible to prevent the inner tank lateral plate 9B from falling at a lower cost because the structure is simple.

Furthermore, for example, in the aforementioned embodiment, a technique has been described in which the guide rollers are rolled on the surfaces of the raised inner tank lateral plate to transfer a next-stage inner tank lateral plate. However, the present disclosure is not limited to this technique. For example, even with guide pairs having the structure shown in FIG. 10, it is possible to transfer a next-stage inner tank lateral plate in the circumferential direction of the tank while the raised inner tank lateral plate is sandwiched between the guide pairs. In the case of adopting guide pairs with the structure shown in FIG. 10, it is preferable that a predetermined gap be made between the raised inner tank lateral plate and the next-stage inner tank substrate so as to prevent the friction from becoming greater, even if the backlash becomes greater to some extent and that the raised inner tank lateral plate is sandwiched between the guide pairs.

Furthermore, for example, in the aforementioned embodiment, a technique has been described in which a horseshoe is welded and the first guide member is attached to the inner tank lateral plate. However, the present disclosure is not limited to this technique. A pre-welded key nut may be utilized to attached the first guide member to the inner tank lateral plate.

Furthermore, for example, in the aforementioned embodiment, a technique has been described in which key nuts are welded in advance to the inward-facing plate surface of the raised inner tank lateral plate. However, the present disclosure is not limited to this technique. For example, in the case where no key nuts are welded to the raised inner tank lateral plate, the first guide member and second guide member that are to be attached to the next-stage inner tank substrate may be put at an equivalent height.

Furthermore, for example, in the aforementioned embodiment, the second guide member is positioned at a level above the first guide member and is installed at a height equivalent to that of the key nuts. However, the present disclosure is not limited to this. In terms of stability of the guide, it is preferable that the first guide member and the second guide member be partially overlapped in a height direction (see FIG. 5).

Furthermore, for example, in the aforementioned embodiment, the first guide member and the second guide member have a similar structure. However, the present disclosure is not limited to this. For example, one of the first guide member and the second guide member may have guide rollers while the other may have no guide rollers. For example, the first guide member to which centrifugal force is applied when transferred in the circumferential direction of the tank may have guide rollers while the second guide member on which centrifugal force has little influence may have no guide rollers (the structure shown in FIG. 10).

Furthermore, for example, the present technique is applicable not only to the aforementioned embodiment, but also obviously to the conventional technique of jacking up the inner tank lateral plate.

INDUSTRIAL APPLICABILITY

According to the present disclosure, in a method for constructing a cylindrical tank that adopts the jack-up construction system, it is possible to securely prevent an inner tank lateral plate to be attached next from falling without requiring complicated operations.

The invention claimed is:

1. A method for constructing a cylindrical tank, comprising the steps of:

assembling a metal inner tank by individually and sequentially conducting, on an internal side of a concrete outer tank, raising of an inner tank lateral plate by a jack-up unit and welding of a next-stage inner tank lateral plate onto a lower section of the raised inner tank lateral plate;

installing a guide pair configured to sandwich the raised inner tank lateral plate onto the next-stage inner tank lateral plate that is to be welded therebeneath; and transferring the next-stage inner tank lateral plate in a circumferential direction of the tank while the raised inner tank lateral plate is sandwiched between the guide pair to utilize the raised inner tank lateral plate as a transfer rail for the next-stage inner tank.

2. The method according to claim 1, wherein the raised inner tank lateral plate is vertically aligned with the next-stage inner tank lateral plate therebeneath while the raised inner tank lateral plate is sandwiched between the guide pair.

3. The method according to claim 1, wherein the guide pair has guide rollers that are configured to be rotatable about rotation shafts extending vertically, and roll on plate surfaces of the raised inner tank lateral plate, and in the transferring step, the next-stage inner tank lateral plate is transferred in a state where a position of the next-stage inner tank lateral plate in a radial direction of the tank coincides with a position of the raised inner tank lateral plate in the radial direction of the tank.

4. The method according to claim 1, wherein a plate surface of the raised inner tank lateral plate that faces an internal side of the tank is provided with a joint to which a jig that positions and fixes the adjacent inner tank lateral plates is attached when the adjacent inner tank lateral plates are welded to each other, the method further comprising the step of installing a first guide member out of a pair of guide members that constitute the guide pair at a level below the joint, the first guide member being opposed to a plate surface of the raised inner tank lateral plate that faces the internal side of the tank.

5. The method according to claim 4, further comprising the step of installing a second guide member out of the pair of the guide members that constitute the guide pair so as to extend to a level above the first guide member, the second guide member being opposed to a plate surface of the raised inner tank lateral plate that faces an external side of the tank.

6. The method according to claim 1, wherein the guide pair has guide rollers that roll on plate surfaces of the raised inner tank lateral plate.

7. The method according to claim 6, wherein a plate surface of the raised inner tank lateral plate that faces an internal side of the tank is provided with a joint to which a jig that positions and fixes the adjacent inner tank lateral plates is attached when the adjacent inner tank lateral plates are welded to each other, the method further comprising the step of installing a first guide member out of a pair of guide members that constitute the guide pair at a level below the joint, the first guide member being opposed to a plate surface of the raised inner tank lateral plate that faces the internal side of the tank.

8. The method according to claim 7, further comprising the step of installing a second guide member out of the pair of the guide members that constitute the guide pair so as to extend to a level above the first guide member, the second guide member being opposed to a plate surface of the raised inner tank lateral plate that faces an external side of the tank.

* * * * *